US008875745B2

(12) United States Patent
Barrett et al.

(10) Patent No.: US 8,875,745 B2
(45) Date of Patent: Nov. 4, 2014

(54) FABRIC FOR FORMING A PAPER WEB HAVING AN EMBOSSED SURFACE

(71) Applicant: Heimbach GmbH & Co. KG, Dueren (DE)

(72) Inventors: Rex Barrett, Neenah, WI (US); Alister John Rigby, Lancashire (GB)

(73) Assignee: Heimbach GmbH & Co. KG, Duren (DE)

( * ) Notice: Subject to any disclaimer, the term of this patent is extended or adjusted under 35 U.S.C. 154(b) by 0 days.

(21) Appl. No.: 13/766,307

(22) Filed: Feb. 13, 2013

(65) Prior Publication Data

US 2013/0220475 A1 Aug. 29, 2013

(30) Foreign Application Priority Data

Feb. 24, 2012 (EP) ..... 12156912

(51) Int. Cl.

| | |
|---|---|
| ***D21F 7/08*** | (2006.01) |
| ***D03D 3/04*** | (2006.01) |
| ***D21F 11/00*** | (2006.01) |
| ***D21F 1/00*** | (2006.01) |
| ***D03D 1/00*** | (2006.01) |
| *D03D 11/00* | (2006.01) |
| *D03D 25/00* | (2006.01) |

(52) U.S. Cl.

CPC ..... *D03D 1/00* (2013.01); *D21F 11/006* (2013.01); *D21F 1/0036* (2013.01)

USPC ..... 139/383 A; 139/383 R; 139/383 AA; 139/410; 139/425 A; 162/358.2

(58) Field of Classification Search

CPC ..... D21F 1/0036; D21F 1/0027; D21F 7/083; D21F 1/0045; D21F 11/006; D21F 7/08; D21F 3/0227; D21F 3/0236; D21F 9/02; Y10S 162/90; Y10S 162/903; Y10S 162/902; Y10S 139/01; Y10S 160/07; Y10S 8/919; D03D 11/00; D03D 15/00; D03D 13/00; D03D 3/04; D03D 23/00; D03D 25/00; D03D 1/0094; D03D 2700/0159; D03D 2700/0162; D10B 2505/00; D10B 2403/0312; B31F 1/07

See application file for complete search history.

(56) References Cited

U.S. PATENT DOCUMENTS

| | | | |
|---|---|---|---|
| 4,759,391 | A | 7/1988 | Waldvogel et al. |
| 4,921,750 | A | 5/1990 | Todd |

(Continued)

FOREIGN PATENT DOCUMENTS

| | | | |
|---|---|---|---|
| CN | 1199438 | A | 11/1998 |
| CN | 1305551 | A | 7/2001 |

(Continued)

OTHER PUBLICATIONS

English translation of Office Action issued Feb. 19, 2014 in corresponding Chinese Patent Application No. 201310054917.5.

*Primary Examiner* — Bobby Muromoto, Jr.
(74) *Attorney, Agent, or Firm* — Berenato & White, LLC

(57) ABSTRACT

A fabric for forming a fibrous paper web having an embossed surface is provided that includes at least longitudinal and transverse threads interwoven with one another in a weave repeat defining a machine side and a paper side. Some of the longitudinal threads form embossing threads having projecting paper side floats on the paper side of the fabric passing over more than one transverse thread. The fabric includes at least a first woven fabric layer forming the paper side on its outside and having longitudinal and transverse first threads interwoven with one another and a second woven fabric layer forming the machine side on its outside and having longitudinal and transverse second threads interwoven with one another. At least some of the longitudinal second threads form embossing threads, which penetrate the first woven fabric layer for forming the paper side floats and connect the two woven fabric layers.

34 Claims, 2 Drawing Sheets

(56) References Cited

U.S. PATENT DOCUMENTS

| | | | | |
|---|---|---|---|---|
| 5,169,711 | A | 12/1992 | Bhatt et al. | |
| 5,429,686 | A | 7/1995 | Chiu et al. | |
| 5,465,764 | A * | 11/1995 | Eschmann et al. | 139/383 A |
| 5,544,678 | A | 8/1996 | Barrett | |
| 5,713,397 | A | 2/1998 | Quigley | |
| 5,826,627 | A * | 10/1998 | Seabrook et al. | 139/383 A |
| 6,237,644 | B1 | 5/2001 | Hay et al. | |
| 7,114,529 | B2 * | 10/2006 | Johnson et al. | 139/383 A |
| 2004/0182466 | A1 * | 9/2004 | Johnson et al. | 139/383 R |
| 2006/0249220 | A1 * | 11/2006 | Barrett et al. | 139/383 A |
| 2007/0209770 | A1 * | 9/2007 | Barrett et al. | 162/358.2 |
| 2008/0169040 | A1 * | 7/2008 | Barrett | 139/383 A |
| 2009/0078388 | A1 * | 3/2009 | Barrett | 162/348 |
| 2010/0236742 | A1 | 9/2010 | Rigby et al. | |

FOREIGN PATENT DOCUMENTS

| | | | |
|---|---|---|---|
| CN | 201520923 | U | 7/2010 |
| CN | 101838950 | A | 9/2010 |
| CN | 102041707 | A | 5/2011 |
| EP | 0232715 | A1 | 1/1987 |
| EP | 2230352 | A1 | 9/2010 |
| FR | 323392 | A | 3/1903 |

* cited by examiner

FABRIC FOR FORMING A PAPER WEB HAVING AN EMBOSSED SURFACE

CROSS-REFERENCE TO RELATED APPLICATIONS AND CLAIM TO PRIORITY

This application is related to patent application number 12 159 912.3, filed Feb. 24, 2012 in the European Patent Office, the disclosure of which is incorporated herein by reference and to which priority is claimed.

FIELD OF THE INVENTION

The invention relates to a fabric for forming a fibrous paper web having an embossed surface, the fabric comprising longitudinal and transverse threads interwoven with one another in a weave repeat unit defining a machine side and a paper side, wherein longitudinal threads form embossing threads having projecting paper side floats on the paper side of the fabric passing over transverse threads.

BACKGROUND OF THE INVENTION

For the manufacture of patterned paper like tissue products such as facial and bath tissue and paper towels or of other non-woven materials, it is known to use fabrics in the paper making machine being employed in making embossed or patterned paper webs products. One type of these fabrics are designed to be installed in the wet forming section of a paper making machine, where a fibrous pulp is deposited onto the paper side outer surface of this fabric (hereby called the paper side) of the forming fabric and is dewatered through the fabric with the help of gravity and suction boxes. At the end of the forming section, the so formed paper web is transferred to a dryer section, where the paper web is dried by applying heat and air streams.

A forming fabric for making embossed paper webs is disclosed in U.S. Pat. No. 6,237,644 B1. The fabric is embodied as a single layer weave having longitudinal or machine direction and transverse or cross machine direction threads interwoven with one another defining a machine side and a paper side. Some or all of the longitudinal threads form embossing threads having projecting paper side floats on the paper side passing over two or more successive transverse threads. Although it is indicated that the fabric can be embodied also as a multi-layer weave, U.S. Pat. No. 6,237,644 B1 does not disclose any example thereof.

Another fabric for the use in the wet forming section of a paper making machine is disclosed in EP 0 232 715 A1. This fabric consists of two superimposed weaves. The first woven fabric layer forming the paper side on its outside is embodied as a fine plain weave, while the fabric layer forming the machine side on its outside is designed coarser. The two layers are connected by additional binding threads or by structural (intrinsic) longitudinal and/or transverse threads of the first woven fabric layer. At the binding points, the first fabric layer is drawn to the second fabric layer thereby forming recesses in a desired pattern. These recesses cause according projections of high volume in the paper web on the surface adjacent to the paper side of the fabric.

In U.S. Pat. No. 5,429,686 A, a through-drying fabric for the drying section of a paper making machine is disclosed, which is intended to manufacture embossed paper webs, too. The fabric is designed as a single layer weave having longitudinal and transverse threads interwoven with one another. Some of the longitudinal threads form floats on the paper side passing over several transverse threads and thus forming elongated projecting paper side floats disposed in a parallel array and providing valleys between the floats. These floats and valleys form a reverse embossing into the adjacent surface of the paper web when dried in the drying section of the paper making machine.

Another through-drying fabric for creating elongated embossings in the paper web is disclosed in U.S. Pat. No. 5,713,397 A. The fabric comprises two superimposed fabric layers having longitudinal and transverse threads interwoven with one another, respectively. The two fabric layers are connected by structural (intrinsic) longitudinal yarns of the first fabric layer forming the paper side on its outside at selected binding points. Some or all of the longitudinal first threads form projecting paper side floats in a desired pattern causing valleys between the floats. The so structured paper side of the first fabric results in reversed embossings on the side of the paper web adjacently to the paper side of the fabric.

With the design of the fabrics as disclosed in the foregoing documents, it is not possible to manufacture paper webs with voluminous embossings. If that is desired, it is necessary to provide an additional coating on the paper side having recesses formed by through holes. However, this kind of fabrics is expensive to manufacture and has a drainage characteristic, which impairs the drainage of the paper web particularly when it is used in the wet forming section.

SUMMARY OF THE INVENTION

Therefore, it is an object of the invention to provide a fabric for forming a paper web having an embossed surface, particularly suited for installation into a wet forming section, which is capable to form voluminous embossings while providing a good drainage capacity.

In order to achieve this object, the fabric according to the invention comprises a first woven fabric layer forming the paper side on its outside and having longitudinal and transverse first threads interwoven with one another and a second woven fabric layer forming the machine side on its outside and having longitudinal and transverse second threads interwoven with one another, wherein at least some of the longitudinal second threads form embossing threads, which penetrate the first woven fabric layer for forming the paper side floats and connect the two woven fabric layers. The general idea of this invention is to provide a fabric having at least two superimposed fabric layers, which are designed as independent weaves having longitudinal and transverse threads interwoven with one another, respectively, and to form the paper side floats not by longitudinal threads of the first woven fabric layer, but of the second woven fabric layer. For forming the paper side floats, the longitudinal second threads penetrate the first woven fabric layer, pass over transverse threads and then penetrate again the first woven fabric layer in order to bind again to the second woven fabric layer, thereby connecting the two woven fabric layers.

The first advantage of this design is that no additional threads are necessary for connecting the two fabric layers, because the connection is effected by structural or intrinsic threads of the second woven fabric layer, which are part of this fabric layer and its weave repeat and which are the embossing threads as well. The second advantage of the fabric according to the invention is that the embossing threads do not belong to the first woven fabric layer and hence, are supported by the entire first woven fabric layer which results in paper side floats projecting more than compared with known fabrics of that kind. Therefore, it is possible to weave the first woven fabric layer using fine threads, which is in general desired for supporting the paper web and retain paper fibers particularly in the wet forming section. Moreover, there is no restriction with respect to the weave pattern of the first woven fabric layer. It can be adapted to the respective requirements in a wide range. For example it may be embodied as a plain weave, twill, broken twill, corduroy or satin with no restriction on the weave and the number of harnesses or sheds. The total open area may be more than 5% and lower than 80%, calculated based on TAPPI standard for Open Area.

In this connection, it is to be considered that a two-layer design for a fabric like this is in general designed so that the threads forming the second woven fabric layer have a greater cross section than the threads used for the first woven fabric layer, because the second woven fabric layer is in general intended to bear the load applied to the fabric in the paper making machine particularly in longitudinal direction. The consequence is that the embossing threads according to the invention have a corresponding cross section resulting in deep recesses between the paper side floats and in according embossings in the paper web.

In a specific embodiment of the invention, the longitudinal second threads form a longitudinal first thread group with outer longitudinal second threads and a longitudinal second thread group with inner longitudinal second threads and that only the outer longitudinal second threads define the outer side of the second woven fabric layer by forming machine side floats crossing at least one transverse second thread, wherein at least some of the inner longitudinal second threads form the embossing threads. Therefore, at least three longitudinal thread groups are formed, the first and the second longitudinal thread group and the second transverse thread forming the second woven fabric layer, and the third longitudinal thread group serving to form the first woven fabric layer. This concept is described in detail in US 2010/0236742 A1.

The advantage of this concept is that all of the longitudinal thread groups can be adapted optimally to their respective functions with regard to their binding into the woven fabric layers, their materials and their cross sections. The arrangement of the second longitudinal threads to outer and inner longitudinal threads enable a functional separation in the sense that by being guided principally on the outer side of the second woven fabric layer, the outer longitudinal second threads can essentially serve to provide a high volume for abrasion resistance, whereas the inner longitudinal second threads essentially determine the tensile strength of the entire fabric and are thus protected from contact with machine elements and so from abrasion. Therefore, the wear arising due to the circulation of the woven fabric with the outer longitudinal second threads has less of an effect upon the overall tensile strength of the woven fabric because the tensile forces are largely absorbed by the inner longitudinal second threads. Consequently, the tensile strength of the entire fabric is largely maintained due to the protected extension of the inner second longitudinal threads over the operating time of the fabric.

In a particularly advantageous embodiment of the invention, the abrasion resistance of the material of the outer longitudinal second threads is preferentially greater than that of the material of which the inner longitudinal second threads are made. Polyamide materials, for example, have particularly high abrasion resistance. The use of copolymers, as known for example from U.S. Pat. No. 5,169,711 A, is also very advantageous. Here monofilaments are disclosed which comprise a mixture of 60 to 90% by weight polyethylene terephthalate polyester (PET polyester) and 40 to 10% by weight thermoplastic polyurethane (PU) and a hydrolyses stabilizer and are characterized by high abrasion resistance. Reference is made explicitly to the overall content of the aforementioned document for the purpose of incorporating the content of the latter into the present description. In addition to this, it is also possible to use other abrasion-resistant materials such as polyester or polypropylene.

Furthermore, the foregoing design opens up the possibility of using for the inner longitudinal threads and hence for the embossing threads, a material, the tensile strength of which is greater than that of the material from which the outer longitudinal second threads are made. Particularly advantageous are the materials polyethylene terephthalate (PET) and/or polyethylene-naphthalate (PEN) or copolymers, using at least one of these materials. It goes without saying that it is advantageous to combine both of the aforementioned measures with one another, i.e. to optimize the outer longitudinal second threads as regards their abrasion resistance with respect to the inner longitudinal second threads and to highlight the tensile strength of the inner longitudinal second threads with respect to the outer longitudinal second threads.

For the longitudinal first threads the materials generally used for this can be considered, preferable—as with the inner longitudinal second threads—PET, PEN or copolymers using at least one of these two materials. In this way the longitudinal first threads also have a high degree of tensile strength. Since in particular when using the fabric in the paper making machine they are not subjected to any abrasion, their contribution to the tensile strength of the fabric as a whole remains largely unchanged over the operating time.

The material for the transverse threads for the intended purpose of the woven fabric is selected from the following group of materials consisting of polyethylene terephthalate (PET), polyamide (PA), polybutylene terephthalate (PBT), polytrimethylene terephthalate (PTT), polyphenylene sulfide (PPS) or copolymers can be considered, using at least one of the aforementioned materials. Other materials may be possible.

According to a further feature of the invention provision is made such that adjacent paper side floats are offset or staggered across the width of the weave repeat unit in order to produce an according pattern of embossings. In particular, adjacent paper side floats can partially overlap each other passing over at least one and the same transverse thread, respectively, or more than one and the same transverse first threads.

In a further embodiment, transverse third threads are provided extending over the paper side and that the paper side floats are supported by the transverse third threads. These third threads enable to create a distance between the first woven fabric layer and the paper side floats thereby enlarging the projection of these floats and the recesses between the floats, particularly if the transverse threads have a cross section selected to create a free distance between the first woven fabric layer and the paper side floats. This can be reached for example by transverse third threads having a cross section being greater than that of the transverse first threads. At least some of the transverse third threads can be laid onto the paper side of the first woven fabric layer. Alternatively thereto, at least some of the transverse third threads are interwoven with the longitudinal first threads of a weave repeat unit provided that their cross section is big enough to create a distance between the first woven fabric layer and the paper side floats. Also a combination of these two kinds of transverse third threads is possible. Moreover, as a variation of this feature within the first woven fabric layer, the transverse first threads are omitted where the transverse third threads are laid onto the paper side of the first woven fabric layer of a weave repeat unit. Also in this case, the transverse third threads should have a cross section supporting the paper side floats rather than the transverse first threads.

In a further embodiment, each paper side float is supported by at least two transverse third threads, wherein said floats are offset or staggered such that one transverse third thread supports one paper side float at the end, where the respective embossing thread forming this paper side float penetrates the first woven fabric layer in direction to the second woven fabric layer, and the adjacent paper side float at the end, where the embossing thread forming this float penetrates the first woven fabric layer in direction to the paper side, respectively. Alternatively thereto or in combination therewith, at least some of the transverse third threads are distributed in such that they support the paper side floats at their middle.

In order to enhance the connection between the woven fabric layers, it is possible that at least some of the transverse third threads are woven as binder threads connecting into the two woven fabric layers by penetrating the fabric layers to the machine side and binding to at least one of the longitudinal second threads at a binding point, preferable where the longitudinal second threads float under at least one or more transverse second threads on their paper side.

In specific cases, at least some of the transverse third threads may be divided into two transverse third threads extending side by side. Moreover, at least some of the transverse third threads are disposed between two adjacent transverse first threads.

When the paper side floats are very long, it is advantageous that the paper side floats are interrupted by binding the embossing threads into the first woven fabric layer, preferable at the middle of the paper side floats. Moreover, the embossing threads can pass under at least one transverse first threads for penetrating the first woven fabric layer to its paper side. An analogous design can be made after penetrating the first woven fabric layer from its paper side so that the embossing threads pass under at least one transverse first thread before returning to the second woven fabric layer.

For the longitudinal second threads forming the embossing threads, and also the other longitudinal threads, a square cross section can be used instead of a round cross section. So-called flat threads are particularly suitable. These flat threads have a cross section the extension of which in the transverse direction of the woven fabric—i.e. at right angles to the designated running direction—is greater than in the thickness direction of the latter, i.e. perpendicularly to the plane of the woven fabric. The longitudinal second thread can, for example, have an oval cross section but are advantageously rectangular in form, for example with a side ratio of 1.1:1, 1.2:1, 1.3:1, 1.4:1 . . . 4:1. The preferred cross sections of height×width [mm] are 0.12×0.19, 0.25×0.3, 0.25×0.33, 0.30×0.45 or 0.3×0.6. The longitudinal second yarns may have a round profile and diameters ranging from 0.10 mm to 0.60 mm. Alternatively, they may have a different profile like a square one having a diameter of 0.1 mm+0.2 mm, 0.2 mm+0.3 mm or 0.2 mm+0.4 mm.

The number of the longitudinal first and second threads in each woven fabric layer may range from four up to sixty per longitudinal repeat unit. The longitudinal first yarns may be vertically aligned with the longitudinal second yarns not being the embossing yarns or may be offset. Ratio of longitudinal first yarn may be equal to, greater than, or less than the longitudinal first yarns.

BRIEF DESCRIPTION OF THE DRAWINGS

In the drawings the invention is illustrated in greater detail by means of exemplary embodiments. These show as follows.

DETAILED DESCRIPTION OF THE PREFERRED EMBODIMENT(S)

Figure 1:
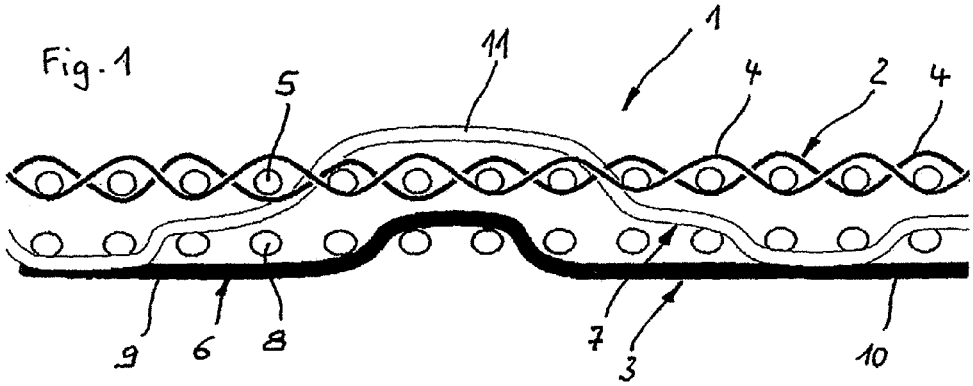
FIG. 1 a longitudinal cross-section through a portion of a first embodiment of a fabric according to the invention.

The fabric 1 illustrated in FIG. 1 has a first woven fabric layer 2 forming a paper side on its outside and a second woven fabric layer 3 forming a machine side on its outside. Both woven fabric layers 2, 3 are superimposed one over the other.

The first woven fabric layer 2 comprises longitudinal first threads 4 and transverse first threads—for example identified by 5—extending at right angles to the latter, which both have a circular cross-section. The longitudinal first threads 4 and the transverse first threads 5 are interwoven with one another to form a plain weave, i.e. the longitudinal first threads 4 respectively bind a transverse first thread 5 on the outer or paper side and the subsequent transverse first thread 5 on the inner side.

The second woven fabric layer 3 is woven from outer longitudinal second threads 6—depicted black in color—and longitudinal embossing threads 7, one of which is shown only, and from transverse second threads—identified for example by 8. Threads 7, 8 have circular cross-section, while the longitudinal second threads 6 have a rectangular cross-section. The outer longitudinal second threads 6 and the embossing threads 7 alternate according to a ratio 1:2.

The outer longitudinal second threads 6 form long machine side floats 9, 10 interrupted by repeatedly binding two adjacent transverse second threads 8 at their inner side. The machine side floats 9, 10 define on their wear side the machine side of the fabric 1.

The embossing threads 7 bind two adjacent transverse second threads 8 on their outside with distance to the plane defined by the machine side, pass between two adjacent transverse first threads 5 and transverse second threads 8, i.e. between the two woven fabric layers 2, 3, then penetrate the first woven fabric layer 2 between two adjacent transverse first threads 5 and then pass over the paper side of the first woven fabric layer 2 forming paper side floats 11 extending over four transverse first threads 5, respectively. Thereafter, the embossing threads 7 penetrate again the first woven fabric layer 2 in machine direction, pass between two adjacent transverse first threads 5 and transverse second threads 8 and then bind two adjacent transverse second threads 8 on the machine side again, thereby connecting both of the woven fabric layers 2, 3.

Since the embossing threads 7 are made of relatively thick monofilaments compared with the longitudinal first threads 4, the paper side floats 11 project significantly over the paper side of the first woven fabric layer 2. The gaps in the first woven fabric layer 2, where the embossing threads 7 penetrate it, are sufficient so that the longitudinal and transverse first threads 4, 5 enclosing these openings are not deflected by the penetrating parts of the embossing threads 7. However, these openings may be smaller than the dimension of the embossing threads 7 resulting in compressing or deflecting the transverse first threads 5 and/or the longitudinal first threads 4.

Since the invention is not limited with respect to the length of the paper side floats 11, they may extend about more than four transverse first threads 5. For example, if the paper side floats 11 have double length, the embossing threads 7 may bind under one transverse first thread 5 preferable in the middle of the paper side float 11 thus forming a short interruption of this float 11.

Figure 2:
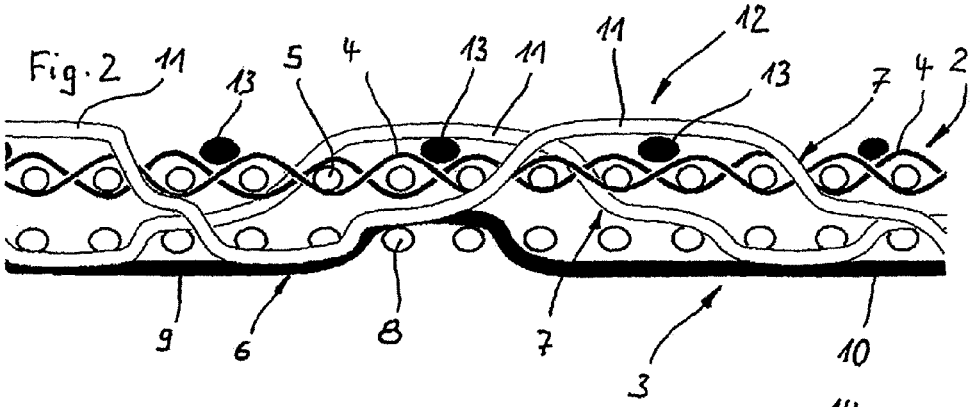
FIG. 2 a longitudinal cross-section through a portion of a second embodiment of a fabric according to the invention.

The second embodiment of the invention shown in FIG. 2 has a similar structure as to the fabric 1 illustrated in FIG. 1. Hence, the same reference numbers are used for the second fabric 12, and it is made reference to the description of the first fabric 1 with respect to the parts provided with the same reference numbers. In FIG. 2, not only one embossing thread 7 is shown but two embossing threads 7 extending adjacently and being offset to one another about three transverse first and second threads 5, 8 such that one transverse first thread 5 is enclosed by two adjacent embossing threads 7, one of which is penetrating in the direction to the paper side and one of which is penetrating in the direction to the second woven fabric layer 3.

The only difference between the first fabric 1 and the second fabric 12 is that additional transverse third threads 13 are laid over the paper side of the first woven fabric layer 2 between two adjacent transverse first threads 5 respectively. The transverse third threads 13 pass under paper side floats 11 of the embossing threads 7 thereby supporting the paper side floats 11 in their middle. Since the transverse third threads 13 are projecting over the paper side of the first woven fabric layer 2, the paper side floats 11 are projecting more than the paper side floats 11 in the fabric 1 shown in FIG. 1 thereby forming recesses between each other.

Figure 3:
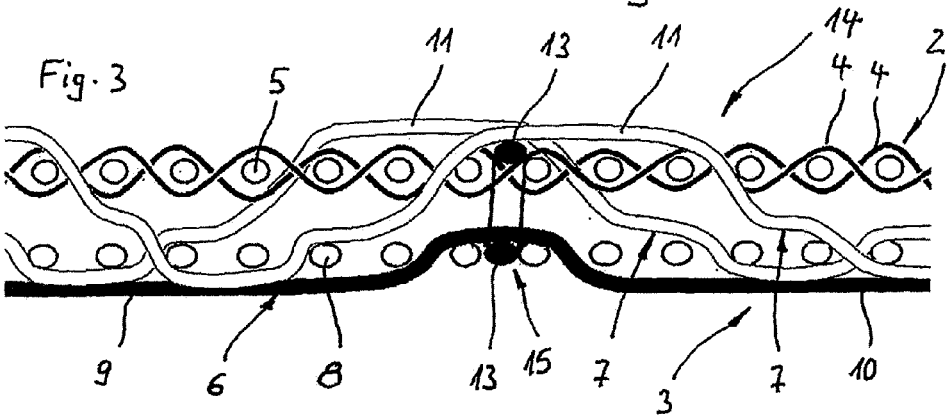
FIG. 3 a longitudinal cross-section through a portion of a third embodiment of a fabric according to the invention.

FIG. 3 illustrates a fabric 14 designed in the same manner as the fabric 1 shown in FIG. 1 and fabric 12 shown in FIG. 2. So also in this case, the same reference numbers are used for the same parts of fabric 14, and for describing these parts it is referred to the description of fabric 1 shown in FIG. 1.

The one difference between fabric 12 (second embodiment) and fabric 14 (third embodiment) is that two adjacent embossing threads 7 are staggered only about two transverse first threads 5 and that the transverse third threads 13 are located so that one and the same transverse third thread 13 supports one paper side float 11 at the end, where the embossing thread 7 forming this paper side float 11 penetrates the first woven fabric layer 2 in direction to the second woven fabric layer 3, and the adjacent paper side float 11 at the end, where the embossing thread 7 forming this paper side float 11 penetrates the first woven fabric layer 2 in direction to the paper side, respectively.

A second difference is that the transverse third threads 13 are woven as binder threads connecting the two woven fabric layers 2, 3 by repeatedly penetrating the woven fabric layers 2, 3 to the machine side and binding one outer longitudinal second thread 6 at binding points 15 between two transverse second threads 8 where the outer longitudinal second thread 6 passes over two transverse second threads 8. Consequently, the two woven fabric layers 2, 3 are connected not only by the embossing threads 7, but also by the transverse third threads 13 thereby providing a stronger connection as in case of the first and second embodiments, where the connection between the two woven fabric layers 2, 3 is caused only by the embossing threads 7.

Figure 4:
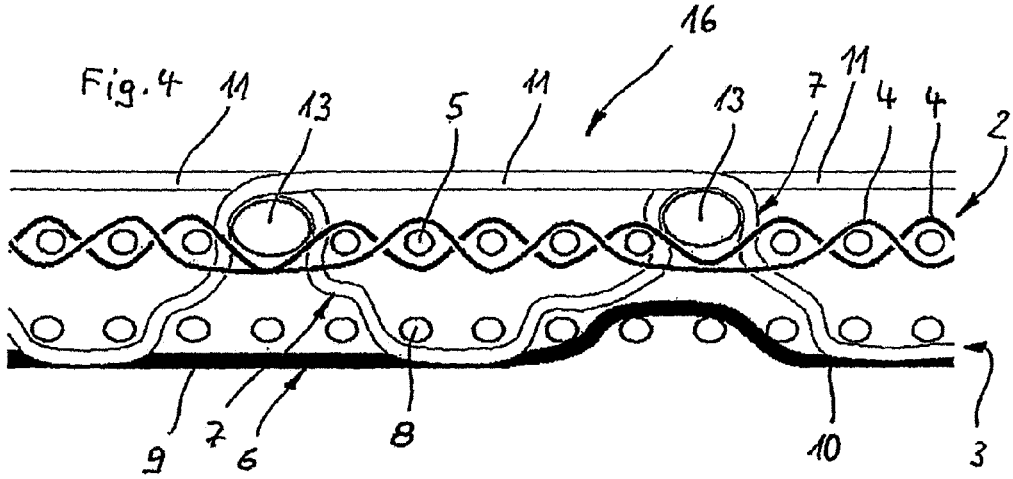
FIG. 4 a longitudinal cross-section through a portion of a fourth embodiment of a fabric according to the invention.

FIG. 4 shows fabric 16 according to the fourth embodiment of the invention. The fabric 16 is designed similar to the fabrics 1, 12, 14 as shown in the foregoing figures. So, the same reference numbers are used for the according parts of these fabrics 1, 12, 14, and for describing these parts it is referred to the description of the fabrics 1, 12 and 14.

Fabric 16 is provided with transverse third threads 13, however in this case replacing every sixth transverse first thread 5, being laid onto the first woven fabric layer 2 and hence, not being bound therein. Consequently, all the longitudinal first threads 4 pass under the inner side of the longitudinal third threads 13 thus forming recesses for them. The transverse third threads 13 have an overall cross-section being much thicker than the cross-sections of the transverse first threads 5. The paper side floats 11 of the embossing threads 7 extend first over one transverse third thread 13 after penetrating the first woven fabric layer 2, then pass over five transverse first threads 5 and over the next transverse third thread 13 and then penetrates the first woven fabric layer 2 between this transverse third thread 13 and the next transverse first thread 5 in the direction to the second woven fabric layer 3. Two adjacent embossing threads 7 are offset so that they bind one transverse third thread 13 in such a way that the one embossing thread 7 penetrates the first woven fabric layer 2 in the direction to the paper side and the other embossing thread 7 penetrates the first woven fabric layer 2 in the direction to the second woven fabric layer 3. Due to the thickness of the transverse third threads 13, the paper side floats 11 are elevated from the paper side of the first woven fabric layer 2.

Figure 5:
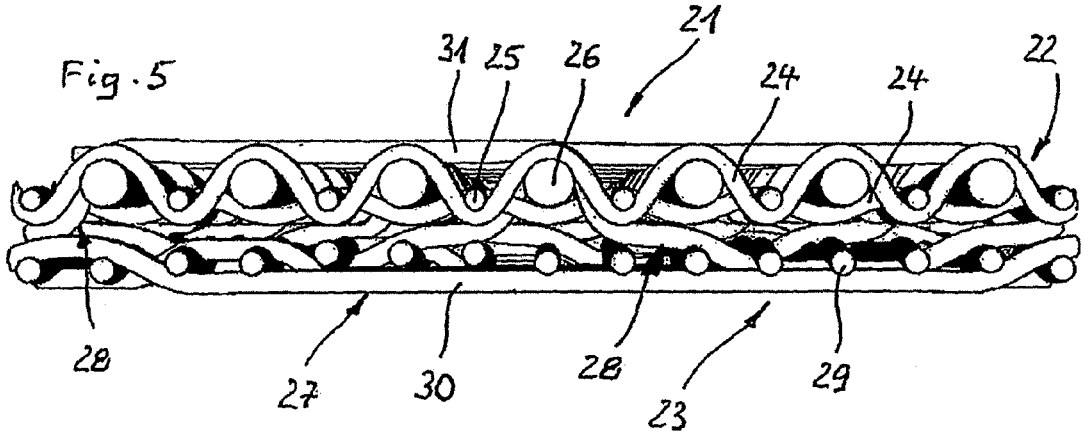
FIG. 5 a longitudinal cross-section through a portion of a fifth embodiment of a fabric according to the invention.

FIG. 5 shows another fabric 21 (fifth embodiment) having a first woven fabric layer 22 and a second woven fabric layer 23 superimposed one over the other.

The first woven fabric layer 22 comprises longitudinal first threads 24 and transverse threads, namely transverse first threads—for example identified by 25—and transverse third threads—for example identified by 26—, all of which have circular cross-sections. The transverse first threads 25 alternate with the transverse third threads 26. The longitudinal first threads 24 on the one hand and the transverse first and third threads 25, 26 on the other hand are interwoven with one another to form a plain weave, i.e. one longitudinal first thread 24 binds a transverse first thread 25 on its paper side and a subsequent transverse third thread 26 on its inner side, while the adjacent longitudinal first thread 24 binds a transverse first thread 25 on its inner side and a subsequent transverse third thread 26 on its paper side.

The second woven fabric layer 23 is woven from outer longitudinal second threads 27 and longitudinal embossing threads 28 and from transverse second threads—identified for example by 29. The outer longitudinal second threads 27 form long machine side floats 30 crossing twelve adjacent transverse second threads 29 on their machine side and interrupted by repeatedly binding two adjacent transverse second threads 29 at their inner side. The machine side floats 30 define on their outside the machine side of the fabric 21.

The embossing threads 28 cross three adjacent transverse second threads 29 on their outside with distance to the level defined by the machine side, pass between the two woven fabric layers 22, 23, then penetrate the first woven fabric layer 22 between a transverse first thread 25 and transverse third thread 26. Thereafter, the embossing threads 28 extend over four transverse third threads 26, thereby supported by these transverse third threads 26 in a significant distance to the transverse first threads 25 and forming paper side floats 31. Thereafter, the embossing threads 28 penetrate again the first woven fabric layer 22 in machine direction, pass between the two woven fabric layers 22, 23 and then bind three adjacent transverse second threads 29 on the machine side again. Thereby both of the woven fabric layers 22, 23 are connected.

In difference to the fabrics 12 shown in FIG. 2, fabric 14 shown in FIG. 3 and fabric 16 shown in FIG. 4, the transverse third threads 26 are interwoven into the first woven fabric layer 22 and hence, belong to the repeat pattern of this layer 22. Since the diameter of the transverse third threads 26 is much bigger than that of the transverse first threads 25, the paper side floats 31 formed by the embossing threads 28 are supported only by the transverse third threads 26 projecting accordingly.

The present invention has been described herein in terms of one or more preferred embodiments. However, it should be understood that numerous modifications and variations to these embodiments would be apparent to those skilled in the art upon a reading of the foregoing description. Therefore, it is intended that any such modifications and variations comprise a part of this invention, provided they come within the scope of the following claims and their equivalents.

We claim:

1. A fabric (1, 12, 14, 16, 21) for forming a fibrous paper web having an embossed surface, the fabric (1, 12, 14, 16, 21) comprising longitudinal and transverse threads (4-8; 24-28) interwoven with one another in a weave repeat unit defining a machine side and a paper side, wherein some of the longitudinal threads form embossing threads (7, 28) having projecting paper side floats (11, 31) on the paper side of the fabric (1, 12, 14, 16, 21) passing over more than one transverse thread (5, 25), wherein the fabric (1, 12, 14, 16, 21) comprises:

a first woven fabric layer (2, 22) forming the paper side on an outside of the first woven fabric layer and having longitudinal and transverse first threads (4, 5, 24, 25) of the longitudinal and transverse threads (4-8; 24-28), wherein the longitudinal and transverse first threads are interwoven with one another; and a second woven fabric layer (3, 23) forming the machine side on an outside of the second woven fabric layer and having longitudinal and transverse second threads (6, 7, 8, 27, 28, 29) of the longitudinal and transverse threads (4-8; 24-28), wherein the longitudinal and transverse second threads are interwoven with one another, wherein some of the longitudinal second threads form the embossing threads (7, 28), which penetrate the first woven fabric layer (2, 22) for forming the paper side floats (11, 31) and connect the first and second woven fabric layers (2, 3, 22, 23).

2. A fabric (1, 12, 14, 16, 21) for forming a fibrous paper web having an embossed surface, the fabric (1, 12, 14, 16, 21) comprising longitudinal and transverse threads (4-8; 24-28) interwoven with one another in a weave repeat unit defining a machine side and a paper side, wherein some of the longitudinal threads form embossing threads (7, 28) having projecting paper side floats (11, 31) on the paper side of the fabric (1, 12, 14, 16, 21) passing over more than one transverse thread (5, 25), wherein the fabric (1, 12, 14, 16, 21) comprises:

a first woven fabric layer (2, 22) forming the paper side on an outside of the first woven fabric layer and having longitudinal and transverse first threads (4, 5, 24, 25) of the longitudinal and transverse threads (4-8; 24-28), wherein the longitudinal and transverse first threads are interwoven with one another; and a second woven fabric layer (3, 23) forming the machine side on an outside of the second woven fabric layer and having longitudinal and transverse second threads (6, 7, 8, 27, 28, 29) of the longitudinal and transverse threads (4-8; 24-28), wherein the longitudinal and transverse second threads are interwoven with one another, wherein some of the longitudinal second threads form the embossing threads (7, 28), which penetrate the first woven fabric layer (2, 22) for forming the paper side floats (11, 31) and connect the first and second woven fabric layers (2, 3, 22, 23), wherein the longitudinal second threads (6, 7, 27, 28) form a longitudinal first thread group with outer longitudinal second threads (6, 27) and a longitudinal second thread group with inner longitudinal second threads (7, 28), wherein only the outer longitudinal second threads (6, 27) define the outside of the second woven fabric layer (3, 23) by forming machine side floats (9, 30) crossing at least one transverse second thread (8, 29), wherein at least some of the inner longitudinal second threads form the embossing threads (7, 28).

3. The fabric according to claim 1, wherein the paper side floats (11, 31) include adjacent paper side floats that are offset across the width of the weave repeat unit.

4. A fabric (1, 12, 14, 16, 21) for forming a fibrous paper web having an embossed surface, the fabric (1, 12, 14, 16, 21) comprising longitudinal and transverse threads (4-8; 24-28) interwoven with one another in a weave repeat unit defining a machine side and a paper side, wherein some of the longitudinal threads foam embossing threads (7, 28) having projecting paper side floats (11, 31) on the paper side of the fabric (1, 12, 14, 16, 21) passing over more than one transverse thread (5, 25), wherein the fabric (1, 12, 14, 16, 21) comprises:

a first woven fabric layer (2, 22) forming the paper side on an outside of the first woven fabric layer and having longitudinal and transverse first threads (4, 5, 24, 25) of the longitudinal and transverse threads (4-8; 24-28), wherein the longitudinal and transverse first threads are interwoven with one another;

a second woven fabric layer (3, 23) forming the machine side on an outside of the second woven fabric layer and having longitudinal and transverse second threads (6, 7, 8, 27, 28, 29) of the longitudinal and transverse threads (4-8; 24-28), wherein the longitudinal and transverse second threads are interwoven with one another; and transverse third threads (13, 26) extending over the paper side and supporting the paper side floats (11, 31), wherein some of the longitudinal second threads form the embossing threads (7, 28), which penetrate the first woven fabric layer (2, 22) for forming the paper side floats (11, 31) and connect the first and second woven fabric layers (2, 3, 22, 23).

5. The fabric according to claim 4, wherein (i) at least some of the transverse third threads (13) are laid onto the paper side of the first woven fabric layer (2), (ii) at least some of the transverse third threads (26) are interwoven with the longitudinal first threads (24) of the weave repeat unit, or (iii) at least some of the transverse third threads (13) are laid onto the paper side of the first woven fabric layer (2) and at least some of the transverse third threads (26) are interwoven with the longitudinal first threads (24) of the weave repeat unit.

6. The fabric according to claim 5, wherein within the first woven fabric layer (2), the transverse first threads (5) are omitted where the transverse third threads (13) are laid onto the paper side of the first woven fabric layer (2) of the weave repeat unit.

7. The fabric according to claim 4, wherein the paper side floats (11, 31) are supported by at least two of the transverse third threads (13, 26), wherein said paper side floats (11, 31) are offset such that one of the transverse third threads (13, 26) supports a first paper side float (11, 31) at an end where the embossing thread (7, 28) forming said first paper side float (11, 31) penetrates the first woven fabric layer (2, 22) in direction to the second woven fabric layer (3, 23), and an adjacent second paper side float (11, 31) at an end where the embossing thread (7, 28) forming said second paper side float (11, 31) penetrates the first woven fabric layer (2, 22) in direction to the paper side, respectively.

8. The fabric according to claim 4, wherein at least some of the transverse third threads (13) are distributed such that said at least some of the transverse third threads (13) support the middles of the paper side floats (11).

9. The fabric according to claim 4, wherein at least some of the transverse third threads (13) are woven as binder threads connecting the first and second woven fabric layers (2, 3) by penetrating the first and second woven fabric layers (2, 3) to the machine side and binding to at least one of the longitudinal second threads (6) at a binding point (15).

10. The fabric according to claim 4, wherein at least some of the transverse third threads are divided into two transverse third threads extending side by side.

11. The fabric according claim 4, wherein at least some of the transverse third threads (13, 26) are disposed between two adjacent transverse first threads (5, 25).

12. The fabric according to claim 1, wherein the paper side floats are interrupted by binding the embossing threads into the first woven fabric layer.

13. The fabric according to claim 1, wherein (i) the embossing threads (7, 31) pass under at least one of the transverse first threads (5, 25) before penetrating the first woven fabric layer (2, 22) to the paper side, (ii) the embossing threads (7, 31) pass under the at least one of the transverse first threads (5, 25) after penetrating the first woven fabric layer (2, 22) from the paper side, or (iii) the embossing threads (7, 31) pass under the at least one transverse first thread (5, 25) before penetrating the first woven fabric layer (2, 22) to the paper side and after penetrating the first woven fabric layer (2, 22) from the paper side.

14. The fabric according to claim 1, wherein the outer longitudinal second threads (6, 27) are interwoven with at least one of the transverse second threads (8, 29) in one weave repeat unit.

15. The fabric according to claim 2, wherein the paper side floats (11, 31) comprise adjacent paper side floats, and wherein the adjacent paper side floats (11, 31) are offset across the width of the weave repeat unit.

16. The fabric according to claim 2, further comprising transverse third threads (13, 26) extending over the paper side, wherein the paper side floats (11, 31) are supported by the transverse third threads (13, 26).

17. The fabric according to claim 3, further comprising transverse third threads (13, 26) extending over the paper side, wherein the paper side floats (11, 31) are supported by the transverse third threads (13, 26).

18. The fabric according to claim 5, wherein the paper side floats (11, 31) are supported by at least two of the transverse third threads (13, 26), wherein said paper side floats (11, 31) are offset such that one of the transverse third threads (13, 26) supports a first paper side float (11, 31) at an end where the embossing thread (7, 28) forming said first paper side float (11, 31) penetrates the first woven fabric layer (2, 22) in direction to the second woven fabric layer (3, 23), and an adjacent second paper side float (11, 31) at an end where the embossing thread (7, 28) forming said second paper side float (11, 31) penetrates the first woven fabric layer (2, 22) in direction to the paper side, respectively.

19. The fabric according to claim 6, wherein the paper side floats (11, 31) are supported by at least two of the transverse third threads (13, 26), wherein said paper side floats (11, 31) are offset such that one of the transverse third threads (13, 26) supports a first paper side float (11, 31) at an end where the embossing thread (7, 28) forming said first paper side float (11, 31) penetrates the first woven fabric layer (2, 22) in direction to the second woven fabric layer (3, 23), and an adjacent second paper side float (11, 31) at an end where the embossing thread (7, 28) forming said second paper side float (11, 31) penetrates the first woven fabric layer (2, 22) in direction to the paper side, respectively.

20. The fabric according to claim 5, wherein at least some of the transverse third threads (13) are distributed such that said at least some of the transverse third threads (13) support the middles of the paper side floats (11).

21. The fabric according to claim 6, wherein at least some of the transverse third threads (13) are distributed in such that said at least some of the transverse third threads (13) support the middles of the paper side floats (11).

22. The fabric according to claim 7, wherein at least some of the transverse third threads (13) are distributed in such that said at least some of the transverse third threads (13) support the middles of the paper side floats (11).

23. The fabric according to claim 2, wherein (i) the abrasion resistance of the material from which the outer longitudinal second threads (6, 27) are made is greater than that of the material from which the inner longitudinal second threads (7, 28) are made, (ii) the tensile strength of the material from which the inner longitudinal second threads (7, 28) are made is greater than that of the material from which the outer longitudinal second threads (6, 27) are made, or (iii) the abrasion resistance of the material from which the outer longitudinal second threads (6, 27) are made is greater than that of the material from which the inner longitudinal second threads (7, 28) are made and the tensile strength of the material from which the inner longitudinal second threads (7, 28) are made is greater than that of the material from which the outer longitudinal second threads (6, 27) are made.

24. The fabric according to claim 3, wherein the paper side floats (11, 31) comprise adjacent paper side floats, and wherein the adjacent paper side floats (11, 31) overlap each other passing over at least one common transverse first thread (5, 25).

25. The fabric according to claim 4, wherein the transverse third threads (13, 26) have a cross section selected to create a distance between the first woven fabric layer (2, 22) and the paper side floats (11, 31).

26. The fabric according to claim 25, wherein the cross section of the transverse third threads (13, 26) is greater than that of the transverse first threads (5, 25).

27. The fabric according to claim 9, wherein the longitudinal second threads (6) float over at least one or more transverse second threads (8) on the paper side.

28. The fabric of claim 1, wherein the paper side floats are interrupted by binding the embossing threads into the first woven fabric layer at the middle of the paper side floats.

29. The fabric according to claim 1, wherein the outer longitudinal second threads (6, 27) are interwoven with two or more consecutive transverse second threads (8, 29) in one weave repeat unit.

30. The fabric according to claim 2, wherein the paper side floats (11, 31) comprise adjacent paper side floats, and wherein the adjacent paper side floats (11, 31) overlap each other passing over at least one common transverse first thread (5, 25).

31. The fabric according to claim 16, wherein the transverse third threads (13, 26) have a cross section selected to create a distance between the first woven fabric layer (2, 22) and the paper side floats (11, 31).

32. The fabric according to claim 31, wherein the cross section of the transverse third threads (13, 26) is greater than that of the transverse first threads (5, 25).

33. The fabric according to claim 17, wherein the transverse third threads (13, 26) have a cross section selected to create a distance between the first woven fabric layer (2, 22) and the paper side floats (11, 31).

34. The fabric according to claim 33, wherein the cross section of the transverse third threads (13, 26) is greater than that of the transverse first threads (5, 25).

* * * * *